US011685071B2

(12) United States Patent
Hoerberg

(10) Patent No.: US 11,685,071 B2
(45) Date of Patent: Jun. 27, 2023

(54) SLICING MACHINE

(71) Applicant: MULTIVAC SEPP HAGGENMUELLER SE & CO. KG, Wolfertschwenden (DE)

(72) Inventor: Winfried Hoerberg, Oberguenzburg (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 17/552,098

(22) Filed: Dec. 15, 2021

(65) Prior Publication Data

US 2022/0184837 A1 Jun. 16, 2022

(30) Foreign Application Priority Data

Dec. 15, 2020 (DE) ..... 102020133580

(51) Int. Cl.
*B26D 7/06* (2006.01)
*B26D 7/01* (2006.01)

(52) U.S. Cl.
CPC ..... *B26D 7/0616* (2013.01); *B26D 7/01* (2013.01); *B26D 2007/011* (2013.01); *B26D 2210/02* (2013.01)

(58) Field of Classification Search
CPC .. B26D 7/0616; B26D 7/0633; B26D 7/0608; F16H 1/00
See application file for complete search history.

(56) References Cited

U.S. PATENT DOCUMENTS

2016/0271822 A1* 9/2016 Burk ..... B26D 7/08
2018/0186011 A1* 7/2018 Pryor ..... B26D 5/00
2021/0323186 A1* 10/2021 Hartmann ..... B26D 5/42

FOREIGN PATENT DOCUMENTS

DE 44 13568 A1 10/1995
DE 198 11418 A1 10/1999
DE 695 1 6 809 T2 10/2000
DE 10 2005 010 184 A1 9/2006
DE 20 2014 000 293 U1 2/2014
DE 102020110425 A1 * 10/2021
(Continued)

OTHER PUBLICATIONS

German Search Report dated Nov. 9, 2011, Application No. 10 2020 133 580.6, Applicant MULTIVAC Sepp Haggenmueller SE & Co. KG, 6 Pages.

*Primary Examiner* — Jennifer S Matthews
(74) *Attorney, Agent, or Firm* — Brooks Kushman P.C.

(57) ABSTRACT

In order to be able to implement a plurality of gripper functions acting independently of one another in a slicing machine without requiring a separate drive unit for each gripper function, a switching unit displaceable along an axial shifting distance is provided. Upon displacement of the switching unit along a first partial distance of a plurality of partial distances of the shifting distance, a caliber contact element is actuated in such a way that a caliber is pushed away from a caliber gripper, and upon shifting of the switching unit along a second partial distance, gripper claws of the caliber gripper are actuated in such a way that they are moved into an engagement position, in which they engage with the caliber, or into a release position, in which they release the caliber.

17 Claims, 13 Drawing Sheets

(56) References Cited

FOREIGN PATENT DOCUMENTS

| | | | | | |
|---|---|---|---|---|---|
| DE | 102021112702 | A1 | * | 11/2022 | |
| EP | 0509230 | A2 | * | 10/1992 | |
| EP | 0 713 753 | A2 | | 5/1996 | |
| WO | 2018/128726 | A1 | | 7/2018 | |
| WO | 2018/202722 | A1 | | 11/2018 | |
| WO | WO-2018202722 | A1 | * | 11/2018 | ..... B26D 5/00 |

* cited by examiner

SLICING MACHINE

CROSS-REFERENCE TO RELATED APPLICATIONS

This application claims priority to German Patent Application No. DE 10 2020 133 580.6 filed on Dec. 15, 2020, the disclosure of which is incorporated in its entirety by reference herein.

TECHNICAL FIELD

The invention relates to slicing machines, in particular so-called slicers, with which strands of an only slightly compressible product such as sausage or cheese are cut into slices in the food industry.

The invention further relates to a method for operating such a slicing machine.

BACKGROUND

Since these strands can be produced with a cross section that retains its shape and dimensions well over its length, i.e., essentially constant, they are called calibers or product calibers.

In most cases, several product calibers are cut side by side at the same time by cutting one slice at a time by the same blade, which moves in a transverse direction to the longitudinal direction of the product calibers.

The product calibers are pushed forward by a feed conveyor in the direction toward the blade, usually on an obliquely downwardly directed feed conveyor, and guided in each case through the product openings of a so-called cutting frame, at the front end of which the part of the product caliber protruding beyond it is cut off as a slice by the blade immediately in front of the cutting frame.

The slices generally fall onto a discharge conveyor, by means of which they are transported away for further processing.

During slicing, the product calibers are usually held at their rear end facing away from the cutting frame by a gripper (hereinafter also referred to as "caliber gripper"), which is provided with corresponding gripper claws for this purpose.

After the one or more product calibers have been cut from an initial length to a minimum final length, it is first necessary to remove the end pieces remaining on the grippers after cutting before reloading the slicer with new product calibers.

In principle, it can be sufficient to open the gripper so that the gripper claws holding the end piece of the product caliber release the end piece. However, if the product caliber is foodstuffs such as sausage or cheese mentioned above, the end piece may remain attached to the base body of the gripper even after the claws have been opened.

To overcome this problem, ejection devices provided on the gripper have already been proposed in the prior art, in which the end piece is removed from the gripper by means of a caliber contact element arranged on the gripper.

In slicing machines of this type, the caliber contact element is usually actuated by a mechanical coupling between the gripper claws and the caliber contact element, which means that the function of the gripper claws is directly coupled to the movement of the caliber contact element. The gripper claws themselves are often controlled by a drive unit, for example in the form of a pneumatic cylinder. For example, a corresponding pneumatic cylinder can be provided on each caliber gripper.

If the caliber contact element is to be actuated separately from the gripper claws and if additional gripper functions are to be implemented, a separate pneumatic cylinder must be provided for the actuation of the caliber contact element and for each additional gripper function, which results in a complex and thus economically disadvantageous embodiment of the gripper.

Furthermore, such pneumatic cylinders must be maintained with care, since even the smallest quantities of lubricant or unclean, in particular oiled, compressed air escaping from the pneumatic cylinder can lead to contamination of the foodstuffs to be processed in the form of the calibers. This effort is increased again accordingly with an increased number of pneumatic cylinders.

SUMMARY

It is therefore the task according to the invention to provide a slicing machine, in particular a slicer, as well as a method for operating such a slicing machine, whereby a plurality of gripper functions acting independently of one another can be realized without requiring a separate drive unit for each gripper function.

With regard to the slicing machine, the object is solved in that the gripper unit comprises

- a drive unit for controlled driving of the switching unit,
- the, in particular axial, shifting distance of the switching unit comprises a plurality of partial distances,
- wherein the switching unit is coupled to the gripper claws and the caliber contact element in such a way that
  - in case of shifting the switching unit along a first partial distance of the plurality of partial distances the caliber contact element is actuated, and
  - in case of shifting the switching unit along a second partial distance of the plurality of partial distances the gripper claws of the at least one product gripper are actuated.

According to the invention, it is possible to actuate both the gripper claws and the caliber contact element of a caliber gripper by means of the switching unit driven by one, preferably single, drive unit, without separate drive units, for example in the form of separate pneumatic cylinders, being required for this purpose.

In addition, the gripper claws and the caliber contact element can be actuated independently of each other, since the first partial distance of the plurality of partial distances is provided for actuating the caliber contact element, whereas the second partial distance is provided for actuating, for example, the gripper claws for opening or closing. Also, after the gripper claws have been opened, it is not absolutely necessary to actuate the caliber contact element at all, but only if this is also desired.

A partial distance can correspond to a part of the shifting distance that has a predetermined length along a shifting direction of the switching unit. The shifting distance can correspond to a working stroke that the switching unit can perform in the shifting direction.

Preferably, the switching unit can be displaced substantially in and against the transport direction of the calibers, i.e., the displacement direction of the switching unit can correspond substantially to the transport direction of the calibers or a direction opposite thereto or run substantially parallel thereto.

Furthermore, it should be noted that the drive unit may be provided not only for actuating a single product gripper of the gripper unit, but also for actuating a plurality of product grippers of the gripper unit. Accordingly, the slicing machine may comprise a separate drive unit for each product gripper or a, preferably single, drive unit for actuating a plurality of the product grippers.

Such a common drive unit is then preferably arranged stationary away from the gripper, for example on the guide for the gripper slide, and the drive movement is transmitted, for example via a control shaft, to the gripper slide which can be moved along a guide.

In principle, the drive unit can be embodied as a pneumatic drive unit. However, in order to counter the disadvantages of a pneumatic drive unit mentioned at the beginning, according to one exemplary embodiment the drive unit can be used as a, preferably electric, servo drive. In addition to increased ease of maintenance, a servo drive is also characterized by an increased maximum actuation speed compared to pneumatic drive units, which can, for example, enable faster opening and closing of the gripper claws. In addition, an actuation speed and/or an actuation force and/or a penetration depth of the gripper claws can be better adapted to the nature of calibers of different foodstuffs. Also, by means of such a servo drive, it is possible to determine the product hardness of a respective caliber at least approximately.

In principle, when actuated by the switching unit, the caliber contact element can act in the transport direction in such a way that the end piece of the caliber is pushed away from the caliber gripper and can then fall down onto an end piece conveyor in order to be conveyed away by means of the end piece conveyor. Furthermore, in order to be able to realize the function of a product recognition, i.e., to recognize whether there is a caliber on a track of the slicing machine assigned to the respective gripper, the caliber contact element can further act as a caliber feeler.

This can be achieved, for example, by the fact that when the switching unit is displaced substantially in the transport direction along the first partial distance, the caliber contact element is moved substantially in the transport direction and can act as a caliber ejector, and when the switching unit is displaced substantially in the opposite direction to the transport direction along the first partial distance, the caliber contact element is moved substantially in the opposite direction to the transport direction and can act as a caliber feeler. If the switching unit is moved substantially opposite to the transport direction along the first partial distance, this movement can thereby be caused by the caliber feeler contact element acting as a caliber feeler, which comes into direct or indirect contact with the caliber.

Furthermore, according to an exemplary embodiment, when the switching unit is displaced substantially in the transport direction along the second partial distance, the gripper claws can be actuated in such a way that they are moved into a release position in which they do not engage with the at least one caliber, i.e., release the caliber, and/or when the switching unit is displaced substantially opposite to the transport direction along the second partial distance, the gripper claws can be actuated in such a way that they are moved into an engagement position in which they engage with the at least one caliber.

Furthermore, the partial distances of the shifting distance may be immediately adjacent in the feeding direction. Therefore, several of the abovementioned functions can be realized via the switching unit with a comparatively small overall length of the axial shifting distance or a comparatively small working stroke of the switching unit.

In addition or alternatively, the switching unit can be embodied as a push rod which can preferably be actuated, i.e., displaced, by the drive unit in the manner described above. However, it is also conceivable in principle to embody the switching unit as a rotating unit, for example a spindle, which can be retracted or extended along the axial shifting distance by a corresponding rotary movement caused by the drive unit.

In principle, it is conceivable that the caliber contact element remains in its position extended in the transport direction after actuation by the switching unit and only returns to its original position when it is transferred back to its retracted position by contact with a further caliber. However, if the caliber contact element is also to be able to be actuated several times in succession by the switching unit, the caliber contact element can furthermore be assigned to a pretensioning element, in particular a spring, which is provided in particular for pretensioning the caliber contact element in the direction of the switching unit.

In further embodiments of this exemplary embodiment, the caliber gripper may further comprise a gripper body having a gripper plate relative to which the caliber contact element is displaceable, preferably substantially in and against the feeding direction, and preferably the pretensioning element, in particular the spring, is supported at one end on the caliber contact element or a part connected thereto and at the other end on the gripper base body, in particular the gripper plate or a part connected thereto.

In order to realize the coupling between the switching unit on the one hand and the gripper claws on the other hand, the switching unit, in particular the push rod, can be coupled to the gripper claws only along the second partial distance, and in particular comprise a switching unit toothing, for example a rod toothing, which is embodied and intended to mesh with a gripper toothing formed on the caliber gripper, for example a gear, during a shifting of the shifting unit along the axial shifting distance, in such a way that the gripper claws can be moved into the engagement position and the release position. The switching unit toothing and the gripper toothing can be embodied in such a way that they engage with each other only when the switching unit is moved along the second partial distance and are otherwise disengaged, i.e., decoupled. A movement of the switching unit substantially in the transport direction can thereby cause a transfer of the gripper claws from the engagement position to the release position, while a movement of the switching unit substantially opposite to the transport direction can cause a transfer of the gripper claws from the release position to the engagement position.

Alternatively, the switching unit, in particular the push rod, can comprise a system of rods which is coupled to the gripper claws and is embodied and intended to cooperate with the gripper claws during a shifting of the switching unit along the axial shifting distance in such a way that the gripper claws can be moved into the engagement position and into the release position. In particular, it is conceivable that the shifting unit and the gripper claws are coupled together along their entire shifting distance by the system of rods.

The axial shifting distance may further comprise a third partial distance, and upon shifting of the shifting unit along the third partial distance, the gripper claws of the at least one product gripper may be actuated to assume a maintenance position, for example. This can be advantageous not only for cleaning the caliber gripper, but also for simplified disassembly of the caliber gripper.

With regard to the method, the object is solved by the fact that, in order to operate a slicing machine, in particular a slicer, in particular a slicer according to the invention the shifting unit is driven in a controlled manner over its entire maximum possible shifting distance, and the switching unit is or is coupled to the gripper claws and/or the caliber contact element of the at least one caliber gripper during a movement along partial distances of the, in particular axial, shifting distance.

It should already be pointed out that all the advantages and effects described with respect to the slicing machine according to the invention also apply to the process according to the invention.

In addition, the switching unit can be displaced substantially in and against the transport direction or substantially parallel thereto.

Furthermore, it is conceivable that the switching unit is coupled to the gripper claws along the entire shifting distance, or that the switching unit is coupled to the gripper claws only during its movement along a predetermined, in particular the second, partial distance of the shifting distance and otherwise remains decoupled therefrom.

Finally, the caliber contact element can be used as a product ejector when the switching unit is displaced substantially in the transport direction along one, in particular the first, partial distance and/or the caliber contact element can be used as the caliber feeler when the switching unit is displaced substantially in the opposite direction to the transport direction along one, in particular the same, partial distance.

BRIEF DESCRIPTION OF THE DRAWINGS

Embodiments according to the invention are described in more detail below by way of example. They show:

FIGS. 1*a*, 1*b* show different perspective views of a slicer 1 for simultaneous slicing of several product calibers K side by side and depositing in shingled portions P of several slices S each with a general pass through direction 10* through the slicer 1 from left to right, and FIG. 1*c* is a side view of this slicer 1.

FIG. 2*a* shows a vertical section through such a slicer 1 in longitudinal direction 10, the transport direction of the calibers K to the cutting unit 7 and thus the longitudinal direction of the calibers K lying in the slicer 1, i.e., with the same viewing direction as FIG. 1*c*, simplified by omitting details less important for the invention.

Figure 1A:
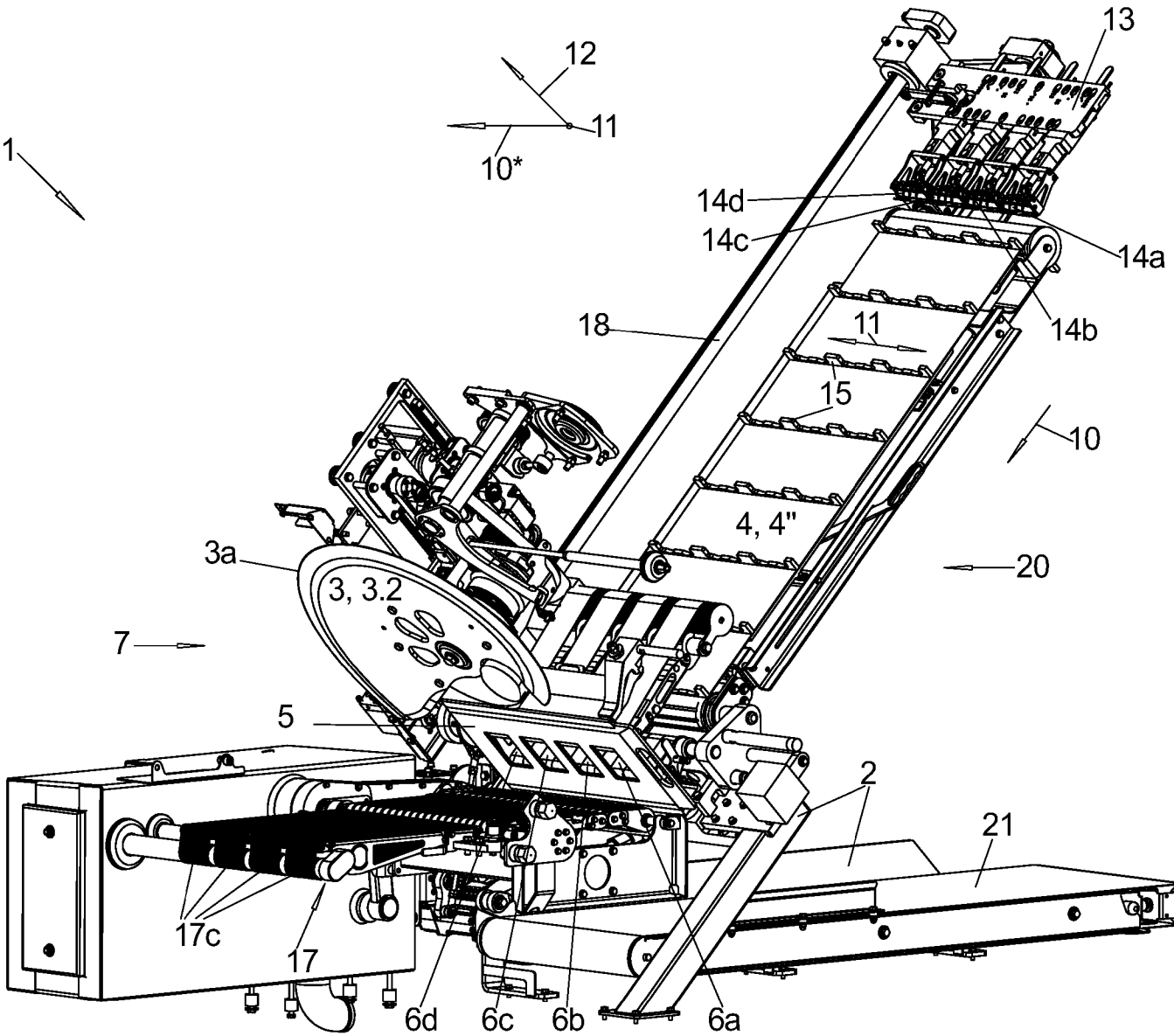
FIGS. 1*a, b*: a slicing machine in the form of a slicer according to the prior art in different perspective views.
Figure 1B:
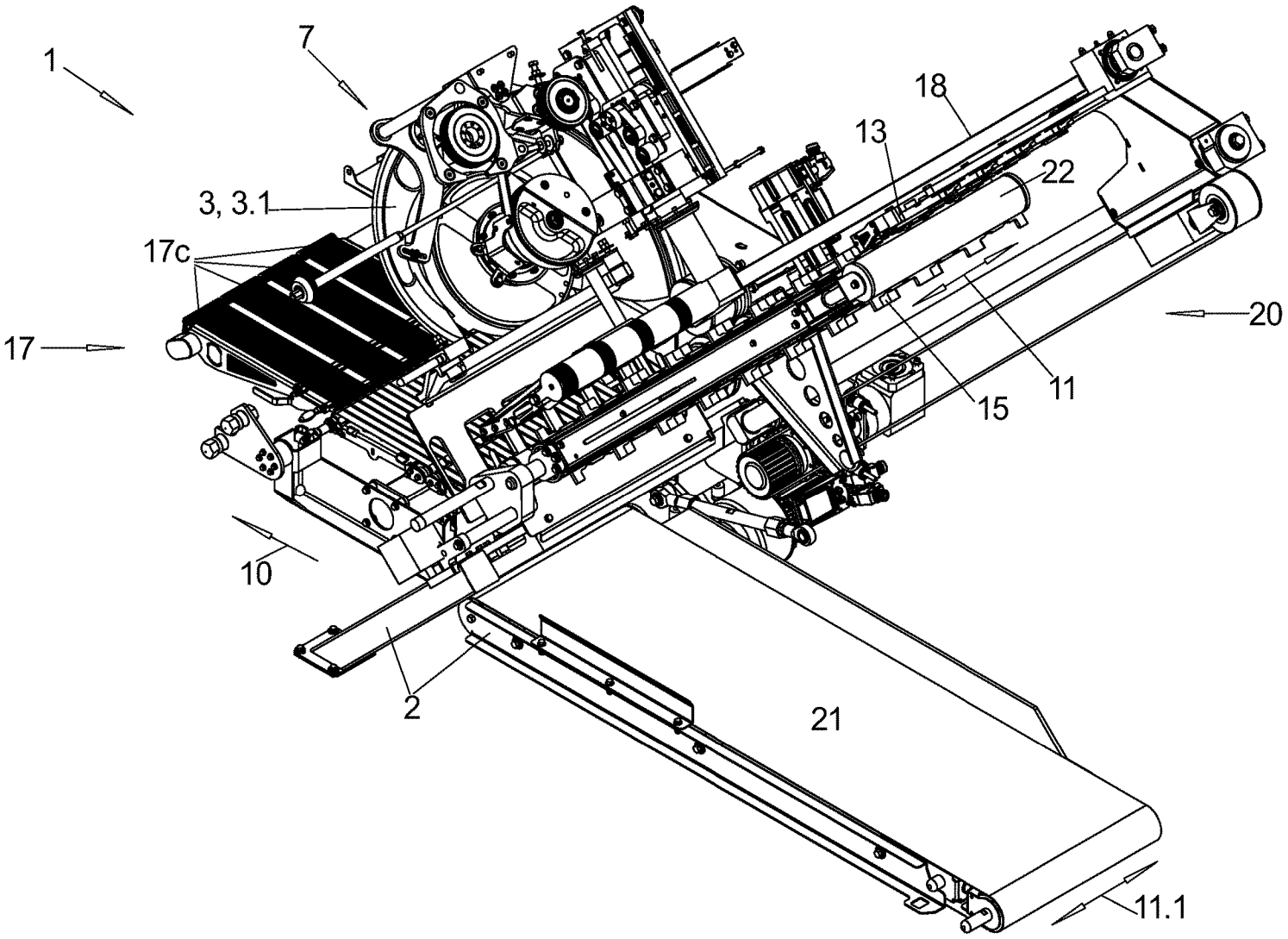

It can be seen that the basic structure of a slicer 1 according to the state of the art is that a cutting unit 7 with a rotating sickle blade 3 is fed with several, in this case four, product calibers K lying next to each other transversely to the transport direction 10 in a feed unit 20, from the front ends of which the rotating sickle blade 3 simultaneously cuts off a slice S in each case.

For this purpose, the feed unit 20 comprises a feed conveyor 4 in the form of an endless, circulating feed belt 4, the upper run of which can be driven at least in the transport direction 10 and also in opposition thereto, the calibers K lying side by side in the width of this feed conveyor 4 being arranged on the feed belt 4 spaced apart in the transport direction 10 by spacers 15 which project outwardly from the feed belt 4 with respect to the direction of circulation, i.e., upwardly from the upper run.

For slitting the product calibers K, the feed conveyor 4 is in the inclined position shown in FIGS. 1*a-c* and 2*a* with a low-lying cutting-side front end and a high-lying rear end, from which it can be tilted down into an approximately horizontal loading position about a pivot axis 20' running in its width direction, the 1st transverse direction 11, which is located in the vicinity of the cutting unit 7.

The rear end of a caliber K—lying in the feed unit 20 is held positively in each case by a gripper 14*a-d* with the aid of gripper claws 16. These grippers 14*a*-14*d*, which can be activated and deactivated with respect to the position of the gripper claws 16, are attached to a common gripper unit 13, which can be fed along a rod shaped gripper guide 18 in the transport direction 10.

Both the feed of the gripper unit 13 and the feed conveyor 4 can be driven in a controlled manner, but the specific feed speed of the calibers K is effected by a so-called upper and lower product guide 8, 9, which engage the upper and lower sides of the calibers K to be cut open at their front end regions near the cutting unit 7:

For the slicing, the front ends of the calibers K are each guided through a product opening 6*a-d* present for each caliber, which are formed in a plateshaped cutting frame 5, which is a component of the cutting unit 7, in that the cutting plane 3" runs directly in front of the front, obliquely downward pointing end face of the cutting frame 5, in which the sickle blade 3 rotates with its cutting edge 3*a* and thus cuts off the projection of the calibers K over the cutting frame 5 as a slice S. The cutting plane 3" runs perpendicular to the upper run of the feed conveyor 4 and/or is spanned by the two transverse directions 11, 12.

The inner circumference of the product openings 6*a-d* of the cutting edge 3*a* of the blade 3 serves as a counter cutting edge.

The product openings 6*a-d* of the replaceable cutting frame 5 are approximately adapted to the cross section shape and size of the calibers K to be cut, but since their cross section size is subject to production-related fluctuations, the cross section of the eye product glass openings 6*a-d* is generally somewhat larger than the cross section of the caliber K to be cut.

In order to nevertheless achieve a good cutting result and to be able to control parameters such as the contact force of the caliber K on the inner circumferential surface of the product opening 6*a-d* and other parameters, the bottom and top product guides 8, 9, each in the form of a conveyor belt, are provided, of which the bottom product guide 9 with its upper run and the top product guide 8 with the lower run of the corresponding conveyor belt are in frictional contact with the underside and top side of the caliber K respectively.

Since both product guides 8, 9 can be driven in a controlled manner, in particular independently of one another, they determine the—continuous or clocked—feed speed of the calibers K through the cutting frame 5. Preferably, the two product guides 8, 9 are present in the 1st transverse direction 11 separately for each caliber K and can be driven controlled.

In addition, at least the upper product guide 8 is displaceable in the 2nd transverse direction 12—which is perpendicular to the surface of the upper run of the feed conveyor 4 tilted up into the cutting position—for adaptation to the height H of the caliber K in this direction. Furthermore, at least one of the product guides 8, 9 can be embodied to be pivotable about one of its deflection rollers 8*a*, 8*b*, 9*a*, 9*b* in order to be able to change the direction of the run of its conveyor belt, resting against the caliber K, to a limited extent.

The slices S, which stand in the space inclined corresponding to the inclined position of the feed unit 20 and cutting unit 7 during slicing, fall onto a discharge unit 17 which starts below the cutting frame 5 and runs in the pass through direction 10* and which in this case consists of several discharge conveyors 17*a, b, c* arranged one behind the other with their upper runs approximately aligned in the pass through direction 10*, one of which can also be embodied as a weighing unit.

Figure 1C:
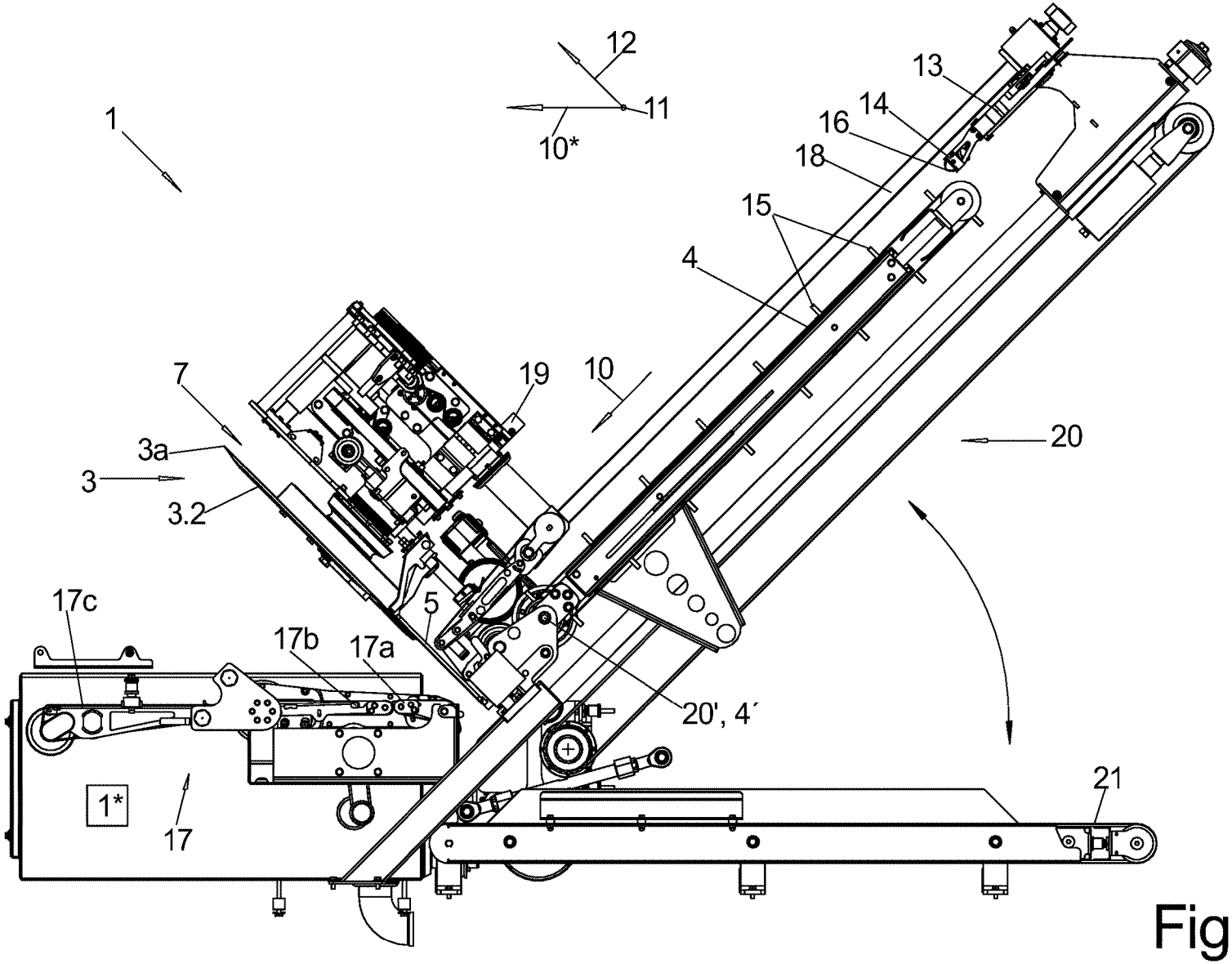
FIG. 1*c*: the slicing machine of FIGS. 1*a*, bin side view.
Figure 2A:
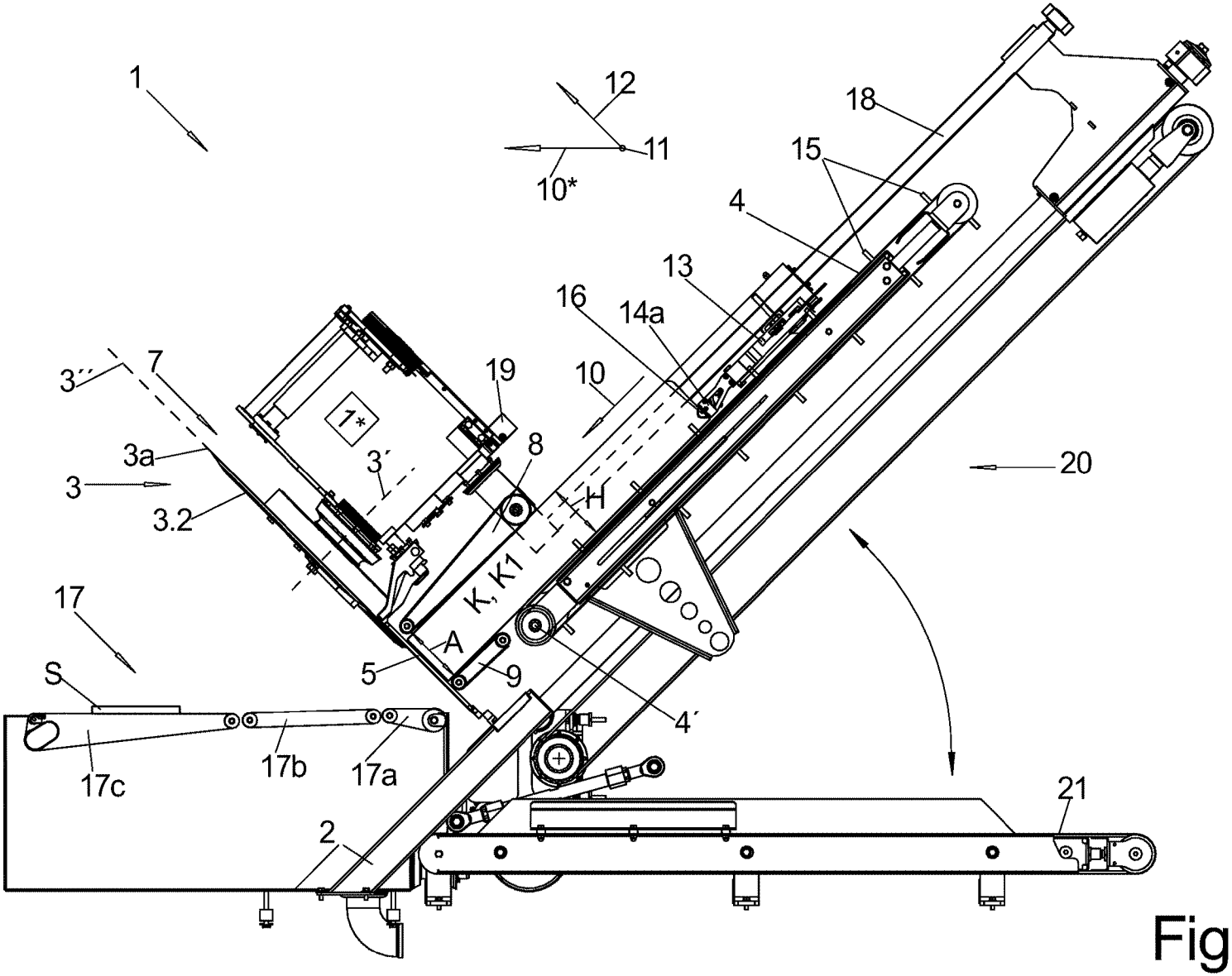
FIG. 2*a*: a simplified vertical longitudinal section through the slicing machine of FIGS. 1*a-c*, i.e., in the same direction of view as FIG. 1*c*, in which the various conveyor belts can be seen more clearly, with the feed belt tilted up into the slicing position.
Figure 2B:
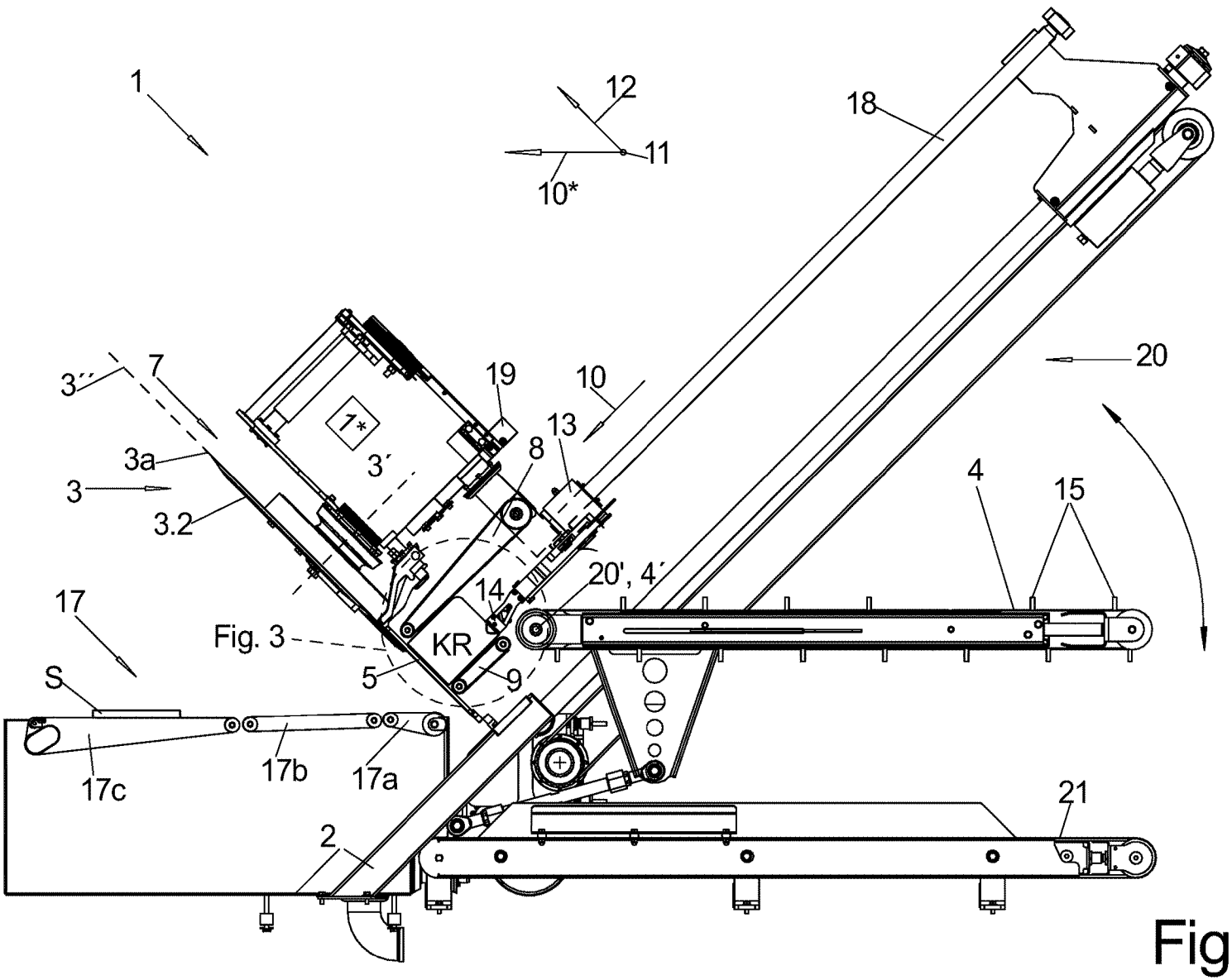
FIG. 2*b*: a longitudinal section as in FIG. 2*a*, but with the infeed belt tilted down into the loading position and the product caliber in an advanced state of cutting.

In this case, the slices S fall either directly onto these discharge conveyors 17*a-c*, as shown for example in FIGS. 1*c*, 2*a* and 2*b*, or onto a packaging element resting thereon, such as a carrier carton or a flat plastic tray.

Below the feed unit 20 there is also an approximately horizontally running end piece conveyor 21, likewise in the form of an endlessly circulating conveyor belt, which starts with its front end below the cutting frame 5 and directly below or behind the discharge unit 17 and with its upper run transports off end pieces falling thereon from there to the rear against the pass through direction 10*.

For this purpose, at least the first discharge conveyor 17*a* in the pass through direction 10* can be driven with its upper run counter to the pass through direction 10* so that an end piece falling thereon, for example, can be transported to the rear and falls onto the lower-lying end piece conveyor 21.

Figure 3:
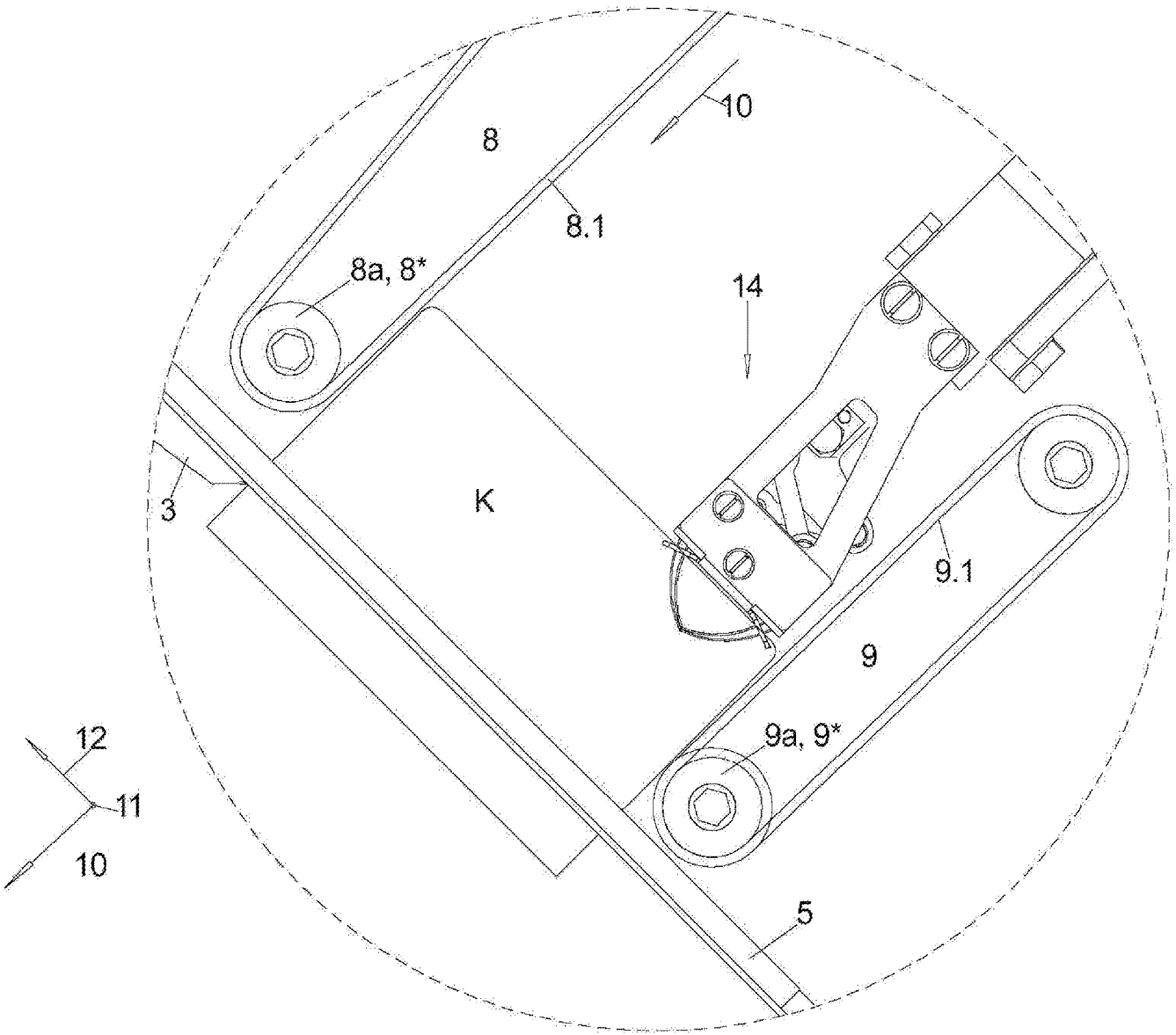
FIG. 3: an enlarged detailed view of a section of FIG. 2*b*, FIG. 4: a schematic view of a caliber gripper with servo drive for the slicing machine according to the invention.

FIG. 3 shows an enlarged detailed view of a section of FIG. 2*b*, in which, in the area of the cutting frame 5 of the slicer 1, the product guides 8, 9 and a product gripper 14, which is attached to the gripper unit 13, holding the caliber K can be seen.

The upper product guide 8 can be driven by a drive unit 8* acting in the region of the deflection roller 8*a*, while the lower product guide 9*a* can be driven by a drive unit 9* acting in the region of the deflection roller 9*a*. Since, as already explained with FIGS. 1*a-c*, the slicer 1 shown is a multi-track slicer 1, the slicer 1 comprises for each track a caliber gripper 14, an upper product guide 8 and a lower product guide 9 arranged opposite thereto with respect to a main plane of the calibers K, i.e., in the 1st transverse direction 11 both a plurality of caliber grippers 14 and a plurality of upper product guides 8 and lower product guides 9.

The special feature according to the invention will now be described in more detail with reference to FIGS. 4 and 5*a*-5*f*.

Figure 4:
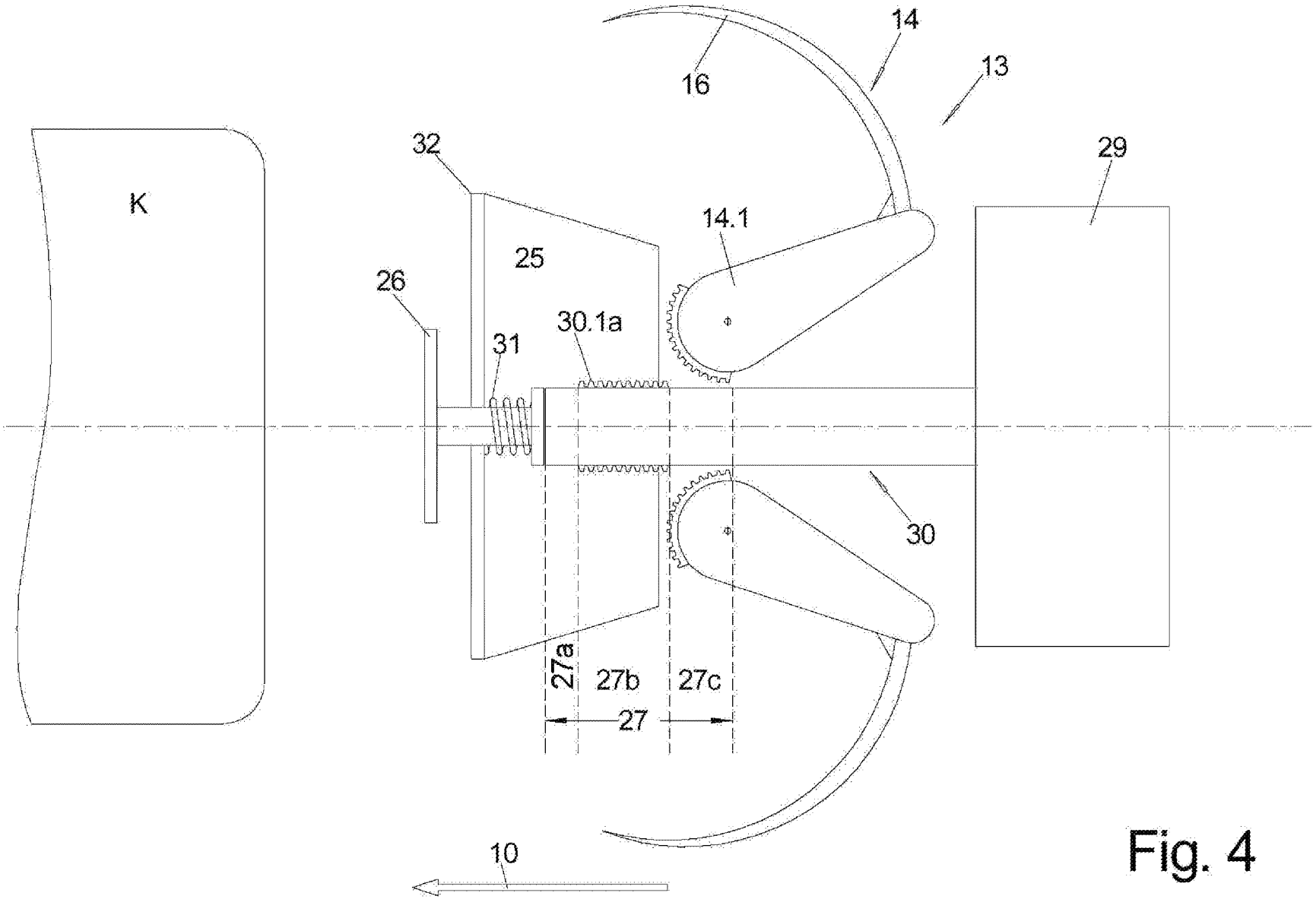

FIG. 4 shows a schematic view of a caliber gripper 14, which is attached to the gripper unit 13 described above. For gripping the caliber K, the caliber gripper 14 comprises the gripper claws 16 described above, which are shown in FIG. 4 in a release position, in which they release the caliber K. The gripper claws 16 are mounted on the gripper unit 13 described above. Furthermore, the caliber gripper 14 comprises a caliber contact element 26 which can be moved in the transport direction 10 of the caliber K in order to be able to push an end piece KR of the caliber K away from a gripper base body 25 having a gripper plate 32 in the form of a scraper plate 32, so that it can fall down onto the end piece conveyor 21 described above and not shown in FIG. 4.

In the Exemplary embodiments shown, the gripper claws 16 and the caliber contact element 26 are actuated by a switching unit 30 in the form of a push rod 30, which can be moved in and against the transport direction 10 by means of a drive unit 29 in the form of an electric servo drive 29. The push rod 30 can be moved along an axial shifting distance 27, which will be explained in more detail with reference to FIGS. 5*a*-5*e*. The axial shifting distance 27 can correspond to a working stroke, which the push rod 30 can perform in its shifting direction—i.e., in the exemplary embodiment shown here—in the transport direction 10.

The force transmission between the push rod 30 and the gripper claws 16 can be effected, on the one hand, by meshing a rod toothing 30.1*a* formed on the push rod 30 with a gripper toothing 14.1 formed on the caliber gripper 14, as shown in FIG. 4.

In order that the caliber contact element 26 can also be actuated several times in succession by the push rod 30, a preloading element 31 in the form of a spring 31 is also assigned to it, which is supported at one end on the stripper plate 32 and at the other end on a flange 25.1 of the caliber contact element 26 and is provided to preload the caliber contact element 26 in the direction of the push rod 30. The actuation of the caliber contact element 26 in the transport direction 10 can thereby be effected by an end of the push rod 30 located in the transport direction 10 approaching the flange 25.1 of the caliber contact element 26 and pushing it away from the stripper plate 32 in the transport direction 10. By the action of the spring 31, the caliber contact element 26 can be moved back again against the transport direction 10 in the direction of the scraper plate 32, preferably until it abuts against the scraper plate 32.

Furthermore, in the exemplary embodiment shown, the caliber contact element 26 can also act as a caliber feeler 26 for detecting a caliber K Namely, if the caliber gripper 14 is moved together with the gripper unit 13 towards a caliber K, the caliber contact element 26 moves against the transport direction 10 in the direction of the scraper plate 32. This in turn also moves the push rod 30 driven by the servo drive 29 against the transport direction 10, which can be detected by a control 1* of the slicer 1 that is operatively connected to the servo drive 29, and can accordingly indicate the presence of a caliber K.

Figure 5A:
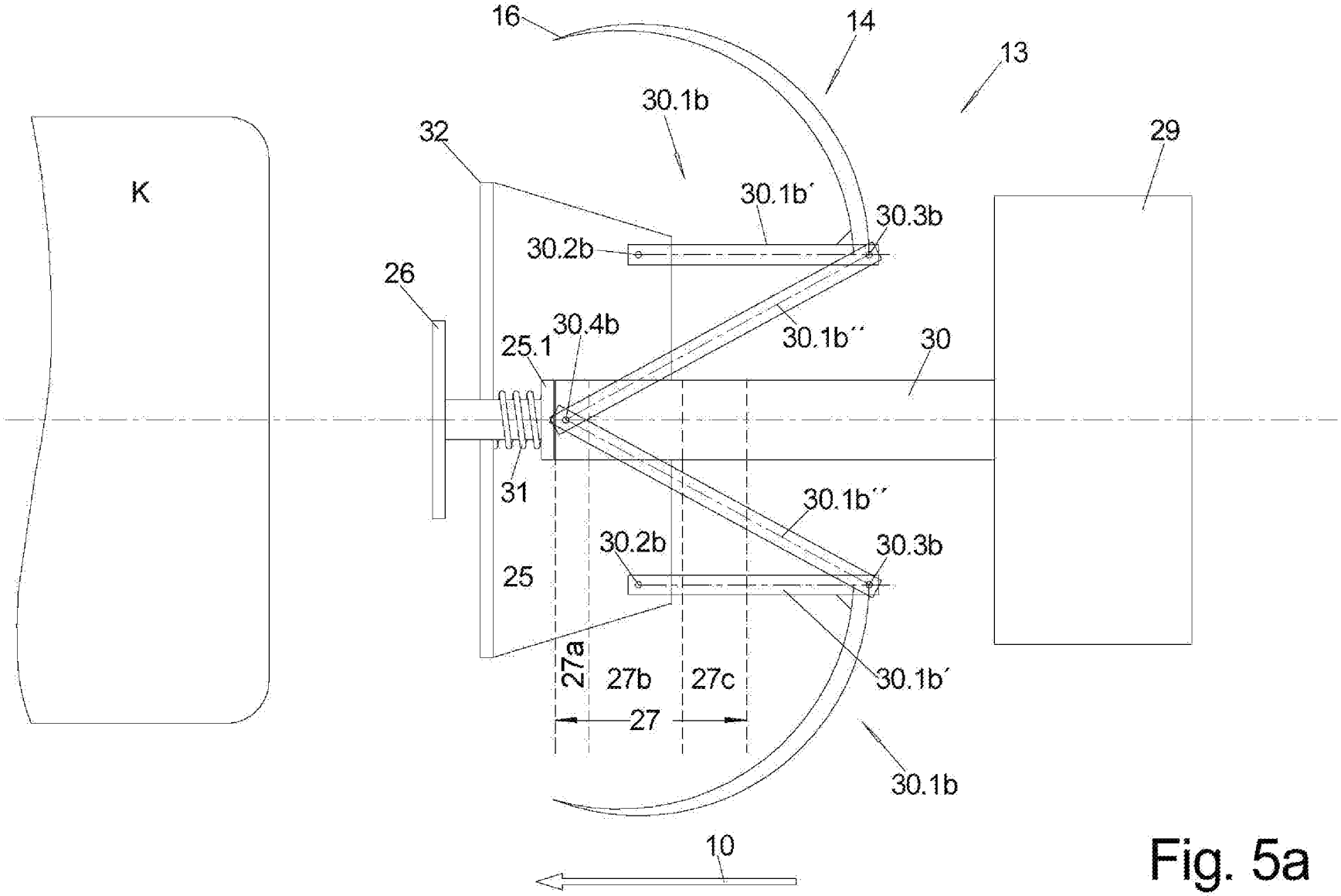
FIGS. 5*a*-5*f*: schematic views of an alternative embodiment of the caliber gripper, in which the caliber gripper is in different working positions.

Alternatively, as shown in FIG. 5*a*, the power transmission between the push rod 30 and the gripper claws 16 can also be effected via a system of rods 30.1*b*, which is connected at one end to the push rod 30 and at the other end to the gripper claw 16. The system of rods 30.1*b* comprises a first rod 30.1*b*' and a second rod 30.1*b*". The first rod 30.1*b*' is thereby fixedly connected to the gripper claw 16 as well as pivotally attached to the gripper body 25 about a first pivot axis 30.2*b*. The second rod 30.1*b*" is connected to the first rod 30.1*b*' at one end so as to be pivotable about a second pivot axis 30.3*b*, and at the other end is connected to the push rod 30 so as to be pivotable about a third pivot axis 30.4*b*. The operation of the caliber contact element 26 corresponds to that which has already been described with reference to the embodiment shown in FIG. 4.

FIGS. 5*a*-5*f* each show schematic views of the caliber gripper 14, in which the caliber gripper 14, in particular the gripper claws 16 and the caliber contact element 26, and the push rod 30 are each in different working positions. In FIGS. 5*a*-5*f*, the caliber gripper 14 is shown in the embodiment in which it comprises the system of rods 30.1*b* described above. However, it should already be pointed out that the following explanations also apply in a substantially analogous manner to the embodiment according to FIG. 4, in which the caliber gripper 14 comprises the gripper toothing 14.1 described above and the push rod 30 comprises the rod toothing 30.1*a* described above.

FIG. 5*a* shows a working position in which a so-called "product search" or "caliber search" is carried out. In this process, the gripper unit 13 is moved together with the caliber feeler in the transport direction 10 until the caliber contact element 26, which initially acts as a caliber feeler 26, has reached a caliber K. The caliber feeler is then moved in the transport direction 10. During the process or movement in the transport direction 10, the caliber feeler is in the extended position, i.e., in the position pushed away from the scraper plate 32 in the transport direction 10

Figure 5B:
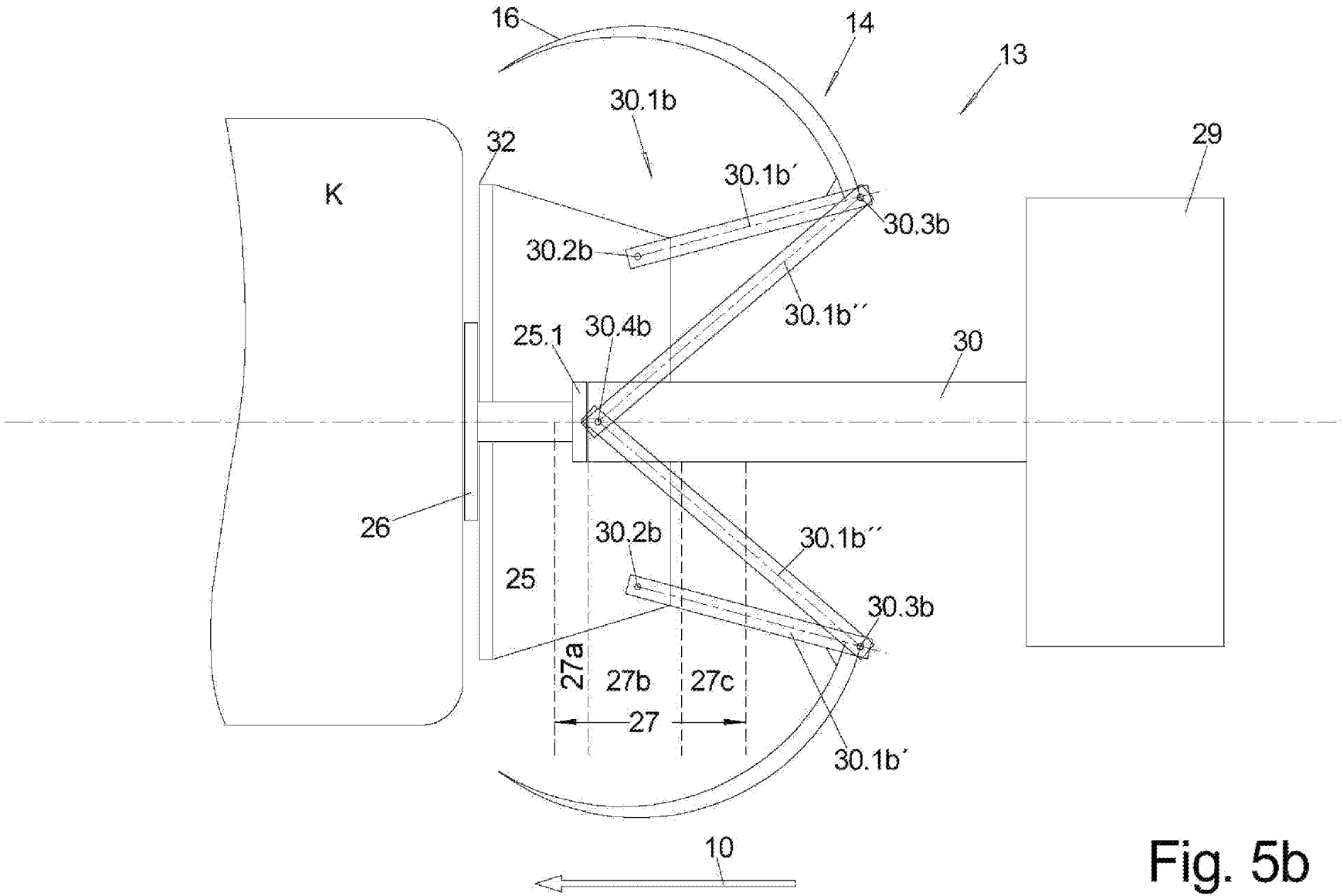

FIG. 5*b* now shows a working position in which the gripper unit 13 or the caliber gripper 14 has reached the caliber K. The caliber is now in the extended position, i.e., pushed away from the scraper plate 32 in the feed direction 10. Therefore the caliber contact element 26 has been moved in the transport direction 10 by a first partial distance 27*a*, which corresponds to a part of the shifting distance 27. As a result of the movement of the caliber contact element 26, the push rod 30 has correspondingly also been moved about the first partial distance 27*a* in the transport direction 10, whereby the presence of the caliber K has been detected in the manner described above and the movement of the gripper unit 13 in the transport direction 10 has been stopped. As a result of the movement of the push rod 30, the system of rods 30.1*b* has also been moved accordingly, causing the gripper claws 16 to move in the direction of the scraper plate 32 so that the gripper claws 16 are at the height of the scraper plate 32 in the transport direction 10.

Figure 5C:
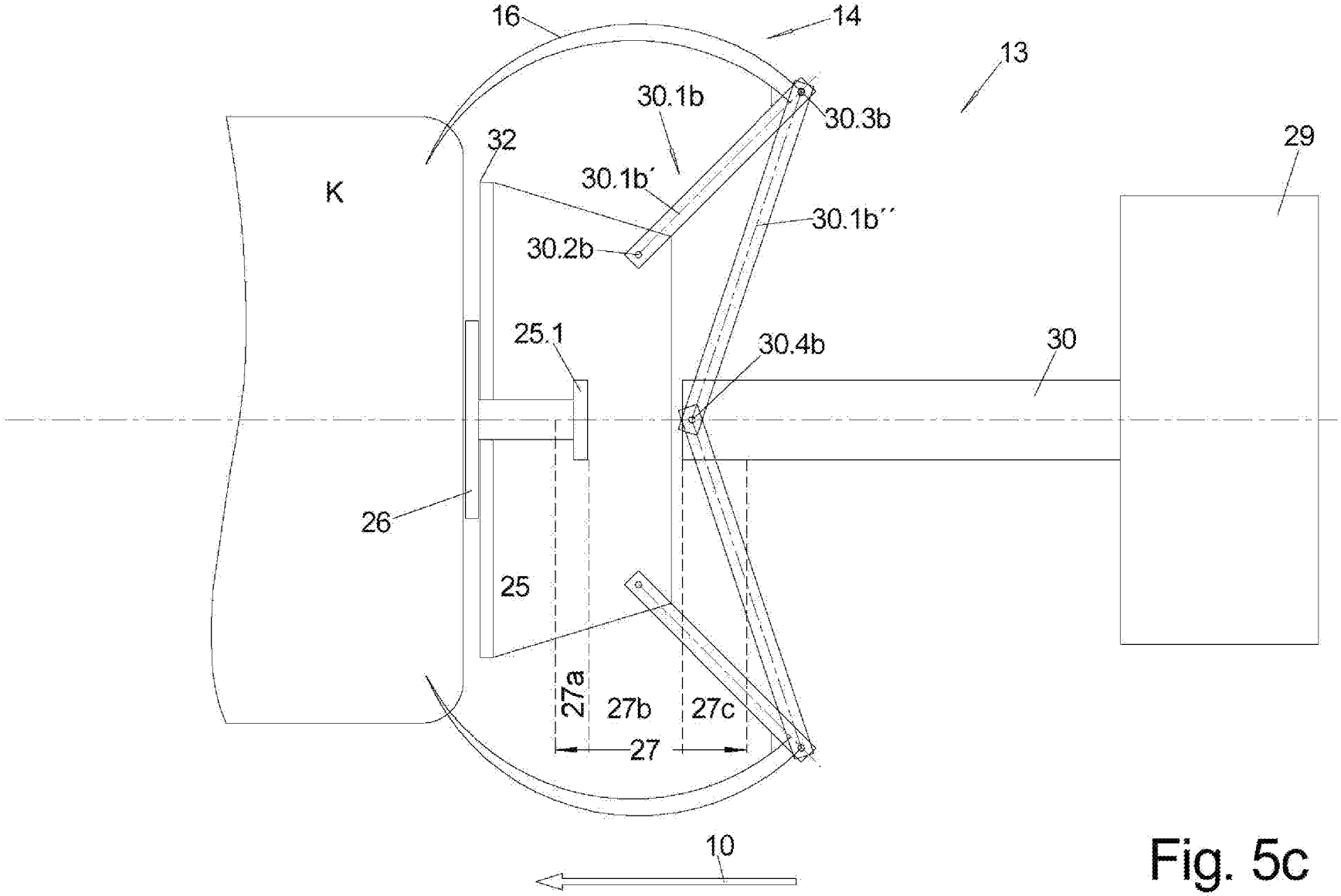

Finally, FIG. 5*c* shows a working position in which the push rod 30 has been moved further by a second partial distance 27*b* against the transport direction 10, starting from the state shown in FIG. 5*b*. As a result of this, the system of rods 30.1*b* has been moved further and thus the gripper claws 16 have been transferred to an engagement position in which they engage with the caliber K, i.e., penetrate into it, whereby the caliber K can be held securely by the gripper claws 16. After the working position shown in FIG. 5*c* has been reached, the gripper unit 13 can be moved further in the transport direction 10, while the caliber K can be cut into slices S by means of the cutting unit 7 with the rotating sickle blade 3 (see FIGS. 2*a* and 2*b*).

Figure 5D:
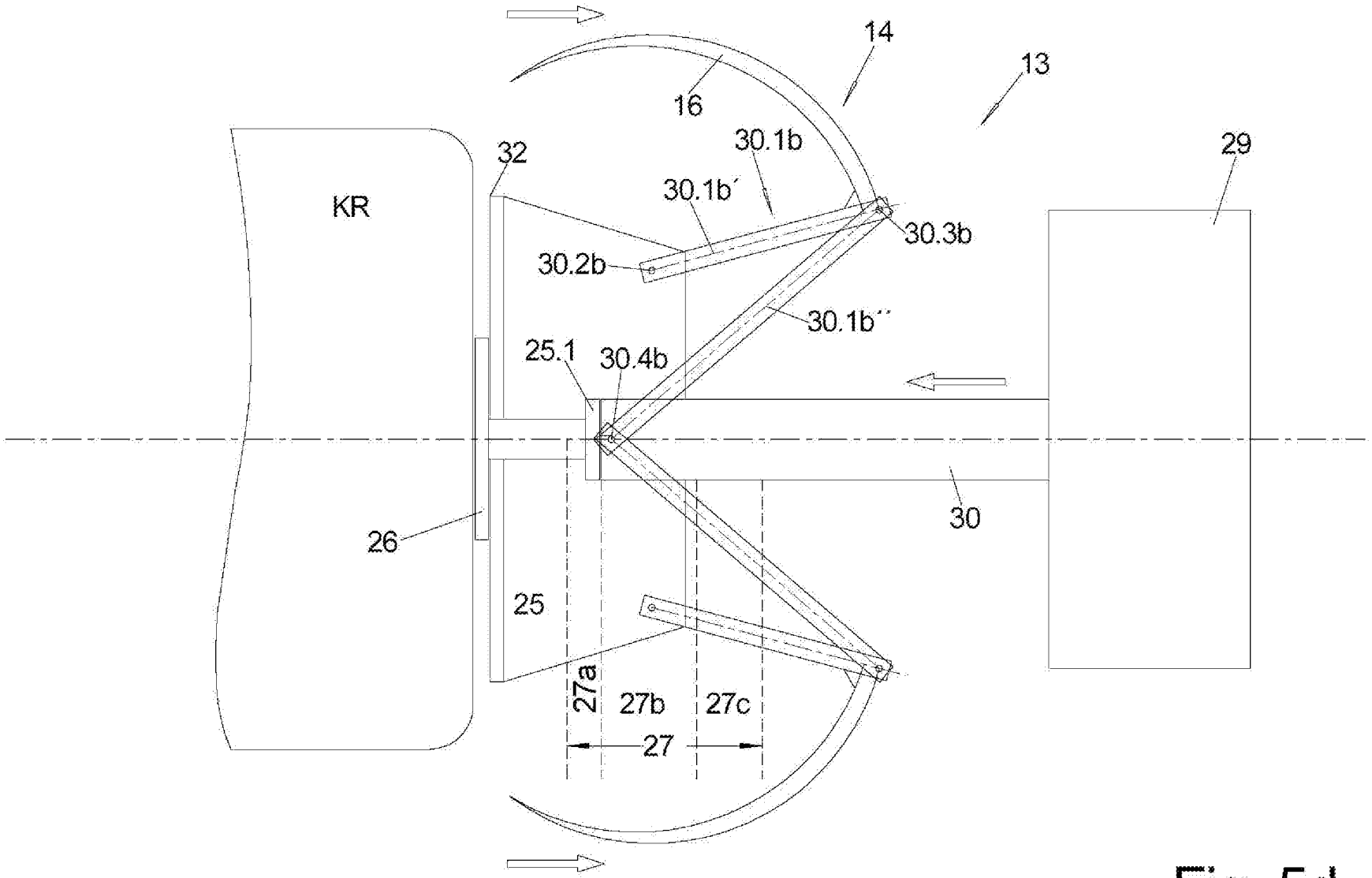

After the caliber K has been cut except for a remaining end piece KR, the gripper claws 16 are first opened, i.e., moved back toward their release position, to release the end piece KR. This state is shown in FIG. 5*d* and is achieved by moving the push rod 30, again by means of the servo drive 29, by the second partial distance 27*b* in the transport direction 10.

Figure 5E:
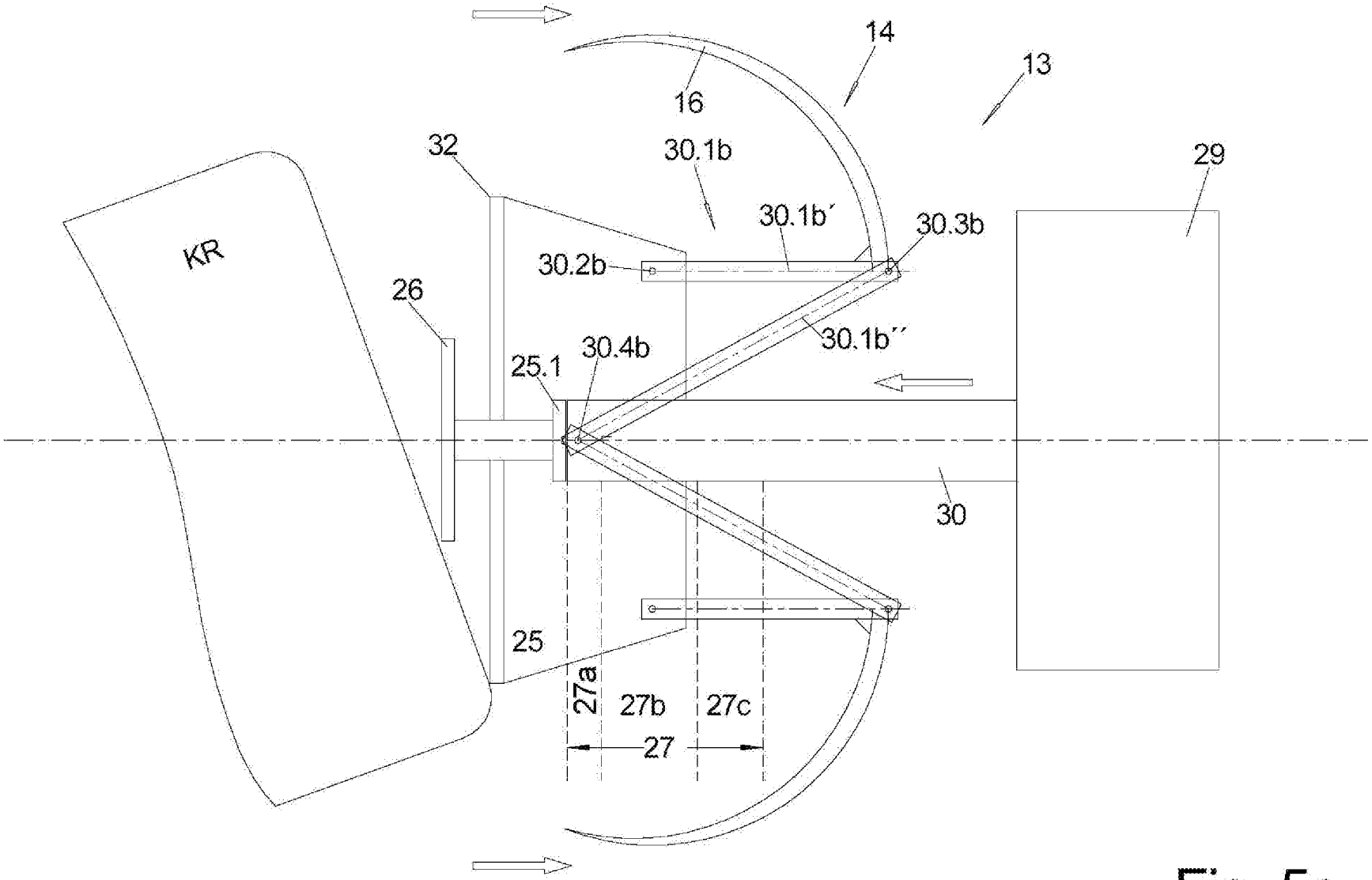

If the end piece KR remains attached to the caliber contact element 26 or the scraper plate 32, the push rod 30 can be moved further by the first partial distance 27*a* in the transport direction 10 by means of the servo drive 29, as finally shown in FIG. 5*e*, whereby the caliber contact element 26 is also actuated in the transport direction 10, so that the end piece KR can be pushed away from the scraper plate 32 and fall down.

Subsequently, the operation described above can again be repeated starting from the working position shown in FIG. 5*a*. The working position shown in FIG. 5*e* preferably corresponds to the working position shown in FIG. 5*a*.

Figure 5F:
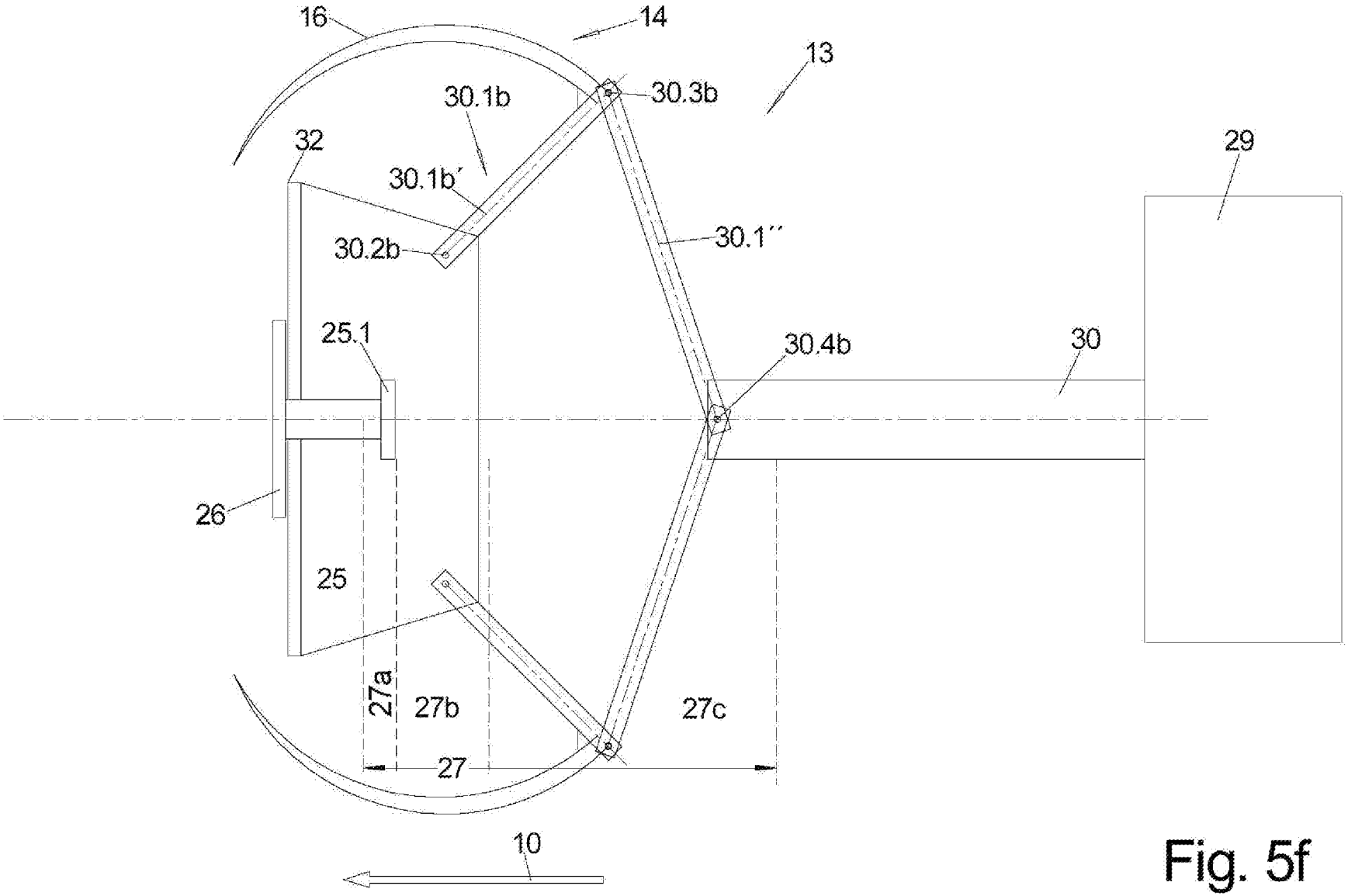

It should be added that the axial shifting distance 27 may further comprise a third partial distance 27*c*, and that upon shifting of the push rod 30 along the third partial distance 27*c* in the transport direction 10, the gripper claws 16 of the at least one caliber gripper 14 are actuated to assume a maintenance position shown in FIG. 5*f*. This can be advantageous not only for cleaning the caliber gripper 14, but also for simplified disassembly of the caliber gripper 14.

Furthermore, it should be added that in the event that the caliber gripper 14 is formed as shown in FIG. 4, whereby it comprises the gripper toothing 14.1 described above and the push rod 30 comprises the rod toothing 30.1*a*, the movement of the gripper claws 16 is preferably coupled to the movement of the push rod 30 only along the second partial distance 27*b*, i.e., the gripper teeth 14.1 and the rod teeth 30.1*a* are engaged with each other only along the second partial distance 27*b* and are otherwise disengaged.

REFERENCE LIST

1 slicing machine, slicer
1* control
2 base frame
3 blade
3 rotation axis
3" blade plane, cutting plane
3*a* cutting edge
4 feed conveyor, feed belt
5 cutting frame
6*a-d* product opening
7 cutting unit
8 upper product guide, upper guide belt
8.1 contact run, lower run
8*a* cutting side deflection roller
8*b* deflection roller facing away from the cutting side
9 bottom product guide, lower guide belt
8.1 contact run, upper run
9*a* cutting side deflection roller
9*b* deflection roller facing away from the cutting side
10 transport direction, longitudinal direction, axial direction
10* pass through direction
11 1. transverse direction (width slicer)
12 2. transverse direction (height direction caliber)
13 gripper unit, gripper slide
14.14*a-d* gripper, product gripper
14.1 gripper toothing
15 spacer
15' support surface
16 gripper claw
17 discharge conveyor unit
17*a, b, c* portioning belt, discharge conveyor
18 gripper guide
19 height sensor
20 feed unit
21 end piece conveyor
22 end piece container
25 gripper body
25.1 flange
26 caliber contact element, caliber ejector, caliber feeler
27 shifting distance
27*a-c* partial distance
28 clutch
29 drive unit, servo drive
30 switching unit, push rod
30.1*a* shift unit toothing, rod toothing
30.1*b* system of rods

30.1*b*' first rod
30.2*b*' second rod
30.2*b* first pivot axis
30.3*b* second pivot axis
30.4*b* third pivot axis
31 preloading element, spring
32 gripper plate, scraper plate
37 spacer
K product, product caliber, caliber
KR end piece
S slice

The invention claimed is:

1. A slicing machine for slicing calibers into slices, comprising:
a cutting unit,
a feed unit for feeding at least one caliber to the cutting unit in a transport direction, the feed unit comprising
a gripper unit having
at least one caliber gripper, which has
gripper claws and
a caliber contact element, and
a switching unit which can be displaced along a shifting distance for actuating the gripper claws and for actuating the caliber contact element,
wherein
a drive unit is provided for controlled driving of the switching unit,
the shifting distance of the switching unit comprises a plurality of partial distances,
the switching unit is coupled to the gripper claws and the caliber contact element in such a manner that
upon displacement of the switching unit along a first partial distance of the plurality of partial distances, the caliber contact element is actuated, and
when the switching unit is displaced along a second partial distance of the plurality of partial distances, the gripper claws of the at least one caliber gripper are actuated, and
the switching unit is coupled to the gripper claws only along the second partial distance.

2. The slicing machine (1) according to claim 1, wherein
the switching unit is displaceable substantially in and against the transport direction
and/or
the drive unit is embodied as a servo drive.

3. The slicing machine according to claim 2, wherein
upon displacement of the switching unit substantially in the transport direction along the first partial distance, the caliber contact element is moved substantially in the transport direction and can act as a caliber ejector
and/or
when the switching unit is displaced substantially opposite to the transport direction along the first partial distance, the caliber contact element is moved substantially opposite to the transport direction and can act as a caliber feeler.

4. The slicing machine according to claim 1,
wherein
when the switching unit is displaced substantially in the transport direction along the second partial distance, the gripper claws are actuated in such a way that they are moved into a release position in which they do not engage in the at least one caliber,
and/or
when the switching unit is displaced counter to the transport direction along the second partial distance, the gripper claws are actuated in such a way that they are moved into an engagement position in which they engage in the at least one caliber.

5. The slicing machine according to claim 1, wherein
the switching unit is embodied as a push rod.

6. The slicing machine according to claim 1,
wherein
the caliber contact element is further associated with a biasing element, which is provided biasing the caliber contact element toward the switching unit.

7. The slicing machine according to claim 6, wherein the biasing element comprises a spring.

8. The slicing machine according to claim 1,
wherein
the at least one caliber gripper further comprises a gripper body having a gripper plate with respect to which the caliber contact element is displaceable
and
the biasing element is supported at one end on the caliber contact element or a part connected thereto and at the other end on the gripper body.

9. The slicing machine according to claim 8, wherein the other end of the biasing element is supported on the gripper plate.

10. The slicing machine according to claim 1,
wherein the switching unit
comprises a switching unit toothing, which is embodied and intended to mesh with a gripper toothing formed on the at least one caliber gripper when the switching unit is displaced along the second partial distance.

11. The slicing machine according to claim 1,
wherein
the shifting distance further comprises a third partial distance of the plurality of partial distances, and
when the switching unit is displaced along the third partial distance, the gripper claws of the at least one caliber gripper are moved to assume a maintenance position.

12. The slicing machine according to claim 1, wherein the switching unit is embodied as a push rod.

13. A method for operating a slicing machine with
a cutting unit,
a feed unit for feeding at least one caliber to the cutting unit along a transport direction, the feed unit comprising
a gripper unit comprising
at least one caliber gripper, which has
gripper claws and
at least one caliber contact element, and
a switching unit which can be displaced along a shifting distance for actuating the gripper claws and for actuating the caliber contact element,
the method comprising:
driving the shifting unit in a controlled manner over its the entire shifting distance, and
coupling the switching unit to the gripper claws only during movement of the shifting unit along a predetermined partial distance of the shafting distance, otherwise the switching unit is decoupled from the gripper claws.

14. The method according to claim 13, comprising displacing the switching unit substantially in and against the transport direction or substantially parallel thereto.

15. The method according to claim 13, comprising
ejecting a product by the caliber contact element when the switching unit is displaced essentially in the transport direction along one partial distance and/or displacing the switching unit substantially in the opposite direction to the transportation direction along the one partial distance to use the caliber contact element as a caliber feeler.

16. A slicing machine for slicing products into slices, comprising:

a cutting unit; and a feed unit for feeding a product to the cutting unit in a transport direction, the feed unit including a gripper unit having a product gripper, which has gripper claws for gripping the product, and a contact element for contacting the product, and a switching unit which can be displaced along a shifting distance for actuating the gripper claws and for actuating the contact element, wherein the shifting distance of the switching unit comprises a plurality of partial distances, wherein the switching unit is coupled to the gripper claws and the contact element in such a manner that upon displacement of the switching unit along a first partial distance of the plurality of partial distances, the contact element is actuated, and when the switching unit is displaced along a second partial distance of the plurality of partial distances, the gripper claws of the product gripper are actuated, and wherein the switching unit is coupled to the gripper claws only along the second partial distance.

17. The slicing machine according to claim 16, wherein the switching unit comprises a switching unit toothing, which is embodied and intended to mesh with a gripper toothing formed on the product gripper when the switching unit is displaced along the second partial distance.

* * * * *